US006871374B2

(12) United States Patent
Brezler, III et al.

(10) Patent No.: US 6,871,374 B2
(45) Date of Patent: Mar. 29, 2005

(54) LOW FRICTION TOOTHBRUSH

(75) Inventors: Russel A. Brezler, III, Mineral Wells, WV (US); Susan E. Loudin, Avondale, PA (US); Charles F. Nelson, Parkersburg, WV (US); Kwai-Yung Benjamin Su, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/805,868

(22) Filed: Mar. 22, 2004

(65) Prior Publication Data

US 2004/0175675 A1 Sep. 9, 2004

Related U.S. Application Data

(62) Division of application No. 09/962,493, filed on Sep. 25, 2001, now abandoned.
(60) Provisional application No. 60/237,302, filed on Oct. 2, 2000.

(51) Int. Cl.[7] ..... A46B 9/04; A61C 15/00
(52) U.S. Cl. ..... 15/207.2; 134/6; 15/167.1
(58) Field of Search ..... 15/167.1, 207.2, 15/206; 300/21; 428/372; 134/6

(56) References Cited

U.S. PATENT DOCUMENTS

| | | | | |
|---|---|---|---|---|
| 2,670,489 | A | | 3/1954 | Cross et al. |
| 3,076,218 | A | | 2/1963 | Cook et al. |
| 5,357,647 | A | | 10/1994 | Gueret |
| 5,462,798 | A | | 10/1995 | Gueret |
| 5,638,568 | A | | 6/1997 | Dumler et al. |
| 5,928,589 | A | | 7/1999 | Norota et al. |
| 6,048,939 | A | | 4/2000 | Priester |
| 6,058,541 | A | | 5/2000 | Masterman et al. |
| 6,087,445 | A | | 7/2000 | Gherghel et al. |
| 6,269,514 | B1 | | 8/2001 | Edwards et al. |
| 6,270,895 | B1 | * | 8/2001 | Needham et al. ..... 428/372 |
| 6,482,511 | B1 | * | 11/2002 | Martinez Antonio ..... 428/364 |

FOREIGN PATENT DOCUMENTS

| | | | |
|---|---|---|---|
| EP | 0322838 | B1 | 7/1989 |
| JP | 62057514 | A | 3/1987 |
| JP | 62082905 | A | 4/1987 |
| JP | 63284227 | A | 11/1988 |
| JP | 01181804 | A | 7/1989 |
| JP | 7222624 | A | 8/1995 |
| JP | 08003818 | A | 1/1996 |
| JP | 08173244 | A | 7/1996 |
| TW | 254975 | A | 8/1995 |
| WO | WO 93/17077 | A1 | 9/1993 |
| WO | WO 98/34514 | A1 | 8/1998 |

OTHER PUBLICATIONS

"Boron Nitride Powder—A Review" by, Donald A. Lelonis, no date provided.*
"Boron Nitride." 2004. http://www.a–m.de/englisch/lexikon/bornitrid.htm.*
"Cubic Boron Nitride (CBN)", no date provided.*
PCT International Search Report, dated Feb. 21, 2002.

* cited by examiner

*Primary Examiner*—Robert J. Warden, Sr.
*Assistant Examiner*—Laura C Cole

(57) ABSTRACT

A brush for use in cleaning teeth, and a method for cleaning teeth using such brush, in which bristles are used in the brush that are prepared from a composition containing a thermoplastic polymeric resin in admixture with a slip agent.

9 Claims, 3 Drawing Sheets

FIG. 7
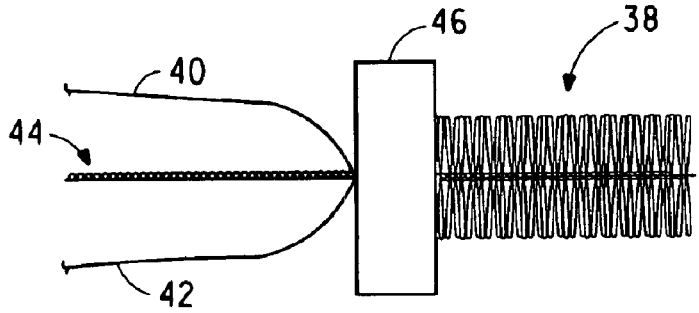
FIG. 8
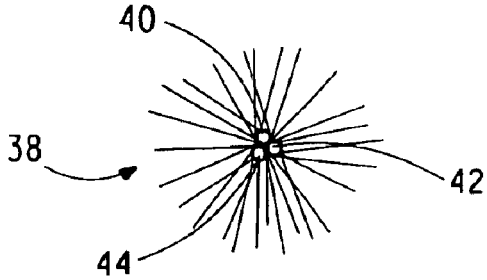
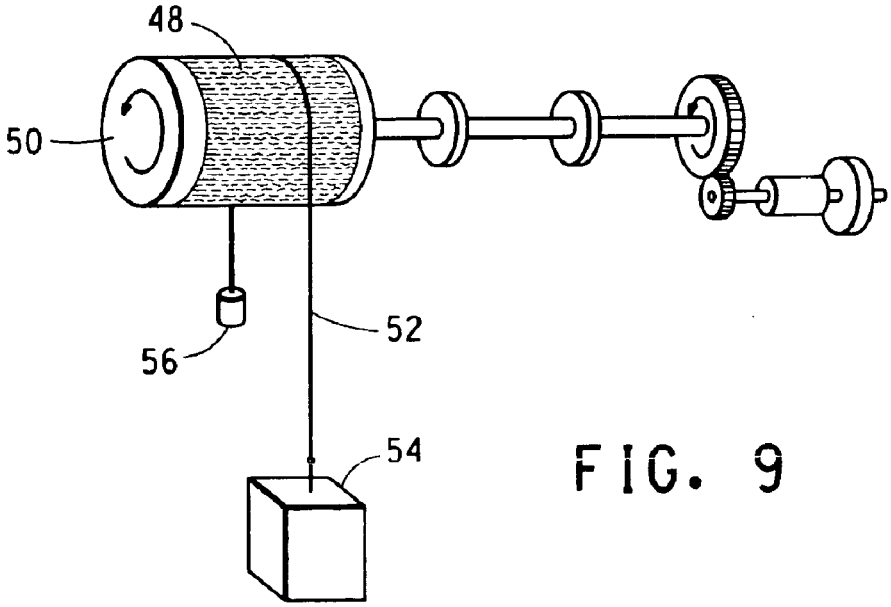
FIG. 9

LOW FRICTION TOOTHBRUSH

This application claims the benefit of U.S. Provisional Application No. 60/237,302, filed Oct. 2, 2000 and U.S. Non-Provisional Application Ser. No. 09/962,493 filed Sep. 25, 2001 now abandoned, of which the present application is a division.

FIELD OF THE INVENTION

The present invention relates to a toothbrush and a method of cleaning teeth. In particular, the invention relates to the use of a composition containing a thermoplastic polymer and a slip agent to prepare a filament for use as a bristle in a toothbrush.

BACKGROUND OF THE INVENTION

Bristles for use in a toothbrush have conventionally been manufactured from a filament that is prepared from a thermoplastic polymer. There is a continuing need to improve the cleaning efficacy of toothbrush bristles manufactured from such polymeric filaments. This invention relates to a method of improving the cleaning efficacy of such a toothbrush bristle by reducing the coefficient of friction that the bristle experiences when in contact with a tooth. It has been found that a useful means of reducing the coefficient of friction experienced by a toothbrush bristle when in contact with a tooth is to manufacture the bristle from a filament prepared from a composition containing a thermoplastic polymer and a slip agent.

U.S. Pat. No. 5,462,798 ("Gueret") discloses a brush used as an applicator for thick liquid cosmetic products such as nail varnish or mascara. The bristles or hairs of the brush are made from a plastic that contains a slip agent. The presence of the slip agent reduces the wettability of the hairs of the applicator, and limits the attachment of the product to the hairs. This condition enhances the tendency of the product to remain on the substrate to which applied, rather than on the hair, and facilitates distribution of a thicker layer of the product on the substrate.

There is no mention in Gueret of the use of such a hair or bristle for cleaning teeth. We have found, however, that the use of a bristle manufactured from a filament prepared from a composition of a thermoplastic polymer and a slip agent does reduce the coefficient of friction experienced by the bristle when in contact with a tooth to such an extent that the cleaning efficacy of the bristle is improved.

SUMMARY OF THE INVENTION

In one aspect, this invention involves a brush for use in cleaning teeth having bristles that are prepared from a composition containing a thermoplastic polymeric resin in admixture with a slip agent.

In another aspect, this invention involves a method of cleaning teeth by (a) providing brush that has bristles that are prepared from a composition containing a thermoplastic polymeric resin in admixture with a slip agent, and (b) applying the brush to the surface of one or more teeth to clean the teeth.

The toothbrush of this invention has been found to possess superior cleaning efficacy, particularly for cleaning between the teeth, because of the presence of a slip agent in the filament from which the toothbrush bristles are manufactured.

BRIEF DESCRIPTION OF THE DRAWINGS

FIG. 7 shows a wrapped bristle toothbrush.

FIG. 8 shows an end view of a wrapped bristle toothbrush.

FIG. 9 shows a boundary frictometer.

DETAILED DESCRIPTION OF THE INVENTION

Figure 1:
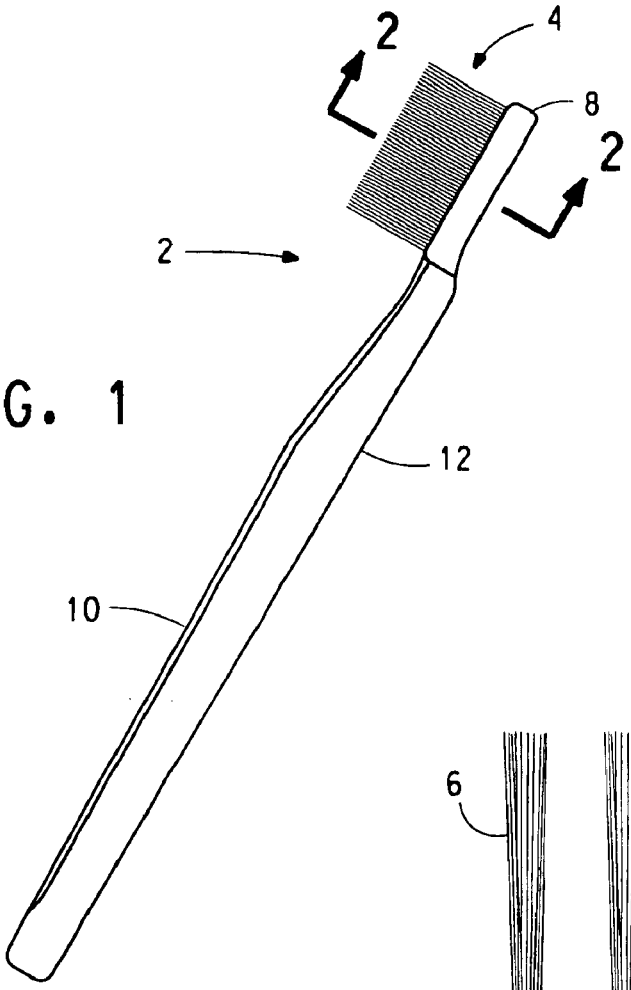
FIG. 1 shows a side elevation of a toothbrush.

The filaments used in this invention for brush bristle manufacture can be produced from a wide variety of well known thermoplastic polymers including polyamides, polyesters, polyolefins, fluoropolymers, polyurethane, polyvinylchloride, polyvinylidene chloride, styrenic polymers and copolymers, and any compatible combination thereof. Polyamides are preferred, and some of those include nylon 6, nylon 11, nylon 6,6, nylon 6,10, nylon 10,10, and nylon 6,12. Polyesters useful for filament production include polybutylene terephthalate and polyethylene terephthalate, and blends thereof. Of the many polyolefins, polypropylene is preferred. Of the above, nylon 6,12 is most preferred.

The polymer(s) from which a filament is produced in this invention, for example nylon, may have an inherent viscosity of about 0.9 to about 1.5 when measured in m-cresol according to ASTM D-2857.

A slip agent for use in this invention is any substance that, when added to a polymer to form a composition from which a filament is produced, will reduce the coefficient of friction experienced by that filament in contact with a tooth when the filament is used as a bristle in a toothbrush. Slip agents useful for preparation of such a composition include, for example, a fluorinated olefin polymer, hexagonal boron nitride, molybdenum disulfide, graphites, fullerene and talc. Of these, a fluorinated olefin polymer such as poly (tetrafluoroethylene) is preferred. A slip agent is used in the composition in an amount of about 0.5 or more, preferably about 1 or more, and more preferably about 2 or more, and yet about 10 or less, preferably about 6 or less, and more preferably about 4 or less, weight percent based on the total weight of the composition of polymer plus slip agent.

Filament production may be accomplished by the use of an extruder, many varieties of which, such as a twin-screw extruder, are available from manufacturers such as Werner and Pfleiderer. A polymer in the form of granules is fed from a feeder unit into the extruder either volumetrically or gravimetrically. A slip agent is fed from a separate feeder into the extruder through a side-arm port, and is blended with the polymer in the extruder at a temperature of 150–285° C. Alternatively, the slip agent can be pre-compounded or pre-blended with the polymer so that a separate feed system is not required. The polymer and slip agent are mixed as a melt in the extruder, and the resulting composition is then metered to a spin pack having a die plate. The composition is filtered, and filaments of various shapes and sizes are produced by extrusion through the holes in the die plate.

The cross-sectional shape of the filament is determined by the shape of the holes in the die plate, and may be any shape such as round, oval, rectangular, triangular, or the shape of any regular polygon; or the filament may be an irregular, non-circular shape. The filament may be solid, hollow or contain multiple longitudinal voids in its cross sections. Each run of the extruder can produce any combination of cross-sectional shapes by using a die plate with various shaped holes. Filaments of one or more diameters may be made at the same time by varying the size of the holes in the die plate. In the toothbrush of this invention, use of a solid, round, single-strand filament, having a substantially uniform cross-sectional dimension, is preferred.

Alternatively, the filament used in this invention may be produced by melt or solution spinning.

In the extrusion process, after a filament strand exits the die plate, it is solidified in a water quench bath, and is then transported through a series of draw rolls for stretching in an amount of 1.5 to 6 times the original length. The filament is drawn in accordance with a repetitive schedule of linear rates involving a period of acceleration and deceleration, and a period of uniform withdrawal. Orientation and stretching is performed between two roll sets, by running the second roll set faster than the first roll set, to improve longitudinal strength of the filament. The oriented filament may then be heated to induce partial crystallization, rendering good bend recovery. The heat setting is typically carried out in a gas, such as by blowing hot air over the filament for a period of about 30 to about 120 seconds, or in a liquid bath, such as by passing the filament through a bath of oil for a period of about 2 to about 10 seconds. The filament is then wound on a winder such as a drum or a spool.

Another aspect of this invention involves the use of a sheath/core filament in which the sheath is produced from polymer admixed with slip agent, but the core is produced from a polymer neat, to which no slip agent has been added. By placing the slip agent in the sheath, more of the slip agent is present at or near the surface of the filament to provide the desired effect of reducing friction. The sheath surrounds the core in a coaxial or concentric configuration. The polymer used in the core and the sheath may be the same or different, but must be compatible since there must be adequate adhesion between the core and the sheath. Nylon 6,12 is preferred as a sheath material.

A sheath/core filament is typically produced by coextrusion using two extruders sharing a common spin pack. The polymer used to make the core is channeled from a first extruder to the center of the spin plate holes, and the composition used to make the sheath is channeled from a second extruder to the outside of the spin plate holes.

A sheath/core filament, which is built from multiple sources of flowable polymer or polymeric composition, as described above, may be distinguished from a filament that is only a single strand because it is produced from a single source of flowable polymeric composition. Such a single-source, single-stranded filament may be referred to as a monofilament. Although a filament for use in this invention may be either a sheath/core filament or a monofilament, a monofilament is preferred.

A filament for use in this invention may be straight, curved, looped or arched; and may be tapered, feathered, tipped or flagged. A straight filament with a smooth, rounded or blunt end is preferred.

A filament for use in this invention has a diameter, or maximum cross-sectional dimension, of about 1 or more, preferably about 2 or more, and more preferably about 2.5 or more, and yet about 15 or less, preferably about 10 or less, and more preferably about 5 or less, mils. A mil is 0.025 mm.

A filament for use in this invention has (1) a tensile modulus of about 100 to about 1000 kpsi, and preferably about 400 to about 700 kpsi, as measured by ASTM D-638; (2) a tensile strength of about 10 to about 100 kpsi, and preferably about 40 to about 80 kpsi, as measured by ASTM D-638; (3) an elongation of about 1 to about 100%, and preferably about 10 to about 50%, as measured by ASTM D-638; and (4) a bend recovery of about 80 to about 100%, and preferably about 92 to about 100%, as measured by the mandrel bend method as described in Bend Recovery of Tynex® and Herox® Nylon Filaments, in Tynex® Nylon Filament Technical Data Bulletin No. 5, September, 1971, available from E.I. du Pont de Nemours and Company.

A filament for use in this invention may contain other additives or have coatings provided that they do not interfere with the operation of the slip agent. For example, the filament may contain anti-microbial additives or therapeutic agents.

A filament is used in this invention as a bristle in a toothbrush. A toothbrush may be made by techniques known in the art, including the staple set, ferrule and filament, metal strip, fusion, or sub-assembly techniques. In a toothbrush, filaments are often grouped together as bristles to form a bristle tuft. Filaments of different colors, diameters, polymer compositions, lengths and shapes can be combined in one tuft to achieve a specific brush characteristic or appearance.

Bristle color is often important in a toothbrush. A filament used in this invention may have any desired color obtained by adding a pigment, dye or colorant to the composition from which the filament is made provided that the operation of the slip agent is not impeded. Bundles of filaments may be produced that contain randomized variations of color and shade. Bristle tufts may thus be manufactured with color or shade variation within a tuft and/or from tuft to tuft, and this allows manufacture of a brush having an attractive visual effect, or in which shade differences are chosen to highlight specific end-product features.

Figure 2:
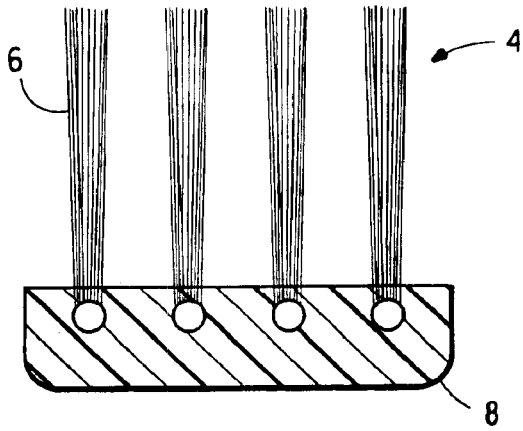
FIG. 2 shows an end elevation of a toothbrush.
Figure 3:
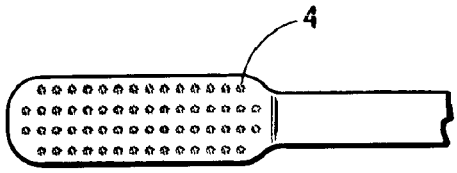
FIG. 3 shows a plan view of a toothbrush.

The term toothbrush refers herein to any type of device in any shape that enables the use of bristles to clean a tooth. In FIGS. 1~3, a typical manual toothbrush 2 is shown in which at least one tuft 4 of bristles 6 is affixed to and extends out in a generally perpendicular direction from a brush head 8, which is a planar, or essentially planar, surface. A tuft 4 will have a plurality of bristles 6 prepared according to this invention, and the head 8 will typically have a plurality of tufts 4. The head 8 is in turn attached to a brush handle 10, and the head 8 and handle 10 make up brush body 12. The configuration of the tufts 4 and head 8 can vary and may be oval, convex curved, concave curved, flat trim, serrated "V", or any other desired configuration. The toothbrush in FIG. 1 contains tufts that are oriented in straight rows and columns, but the tufts may be arrayed in any manner, for example with a diagonal orientation or with each succeeding row or column offset from the previous. While the illustrated embodiment shows that the length of the bristles are substantially the same, the bristles can be cut to any desired length, to differing lengths, to other shapes, such as grooved, or other configurations as desired. The length of the portion of the bristles protruding from the brush head will typically be substantially uniform, and will be between about 5 to about 15 mm, and preferably between about 8 to about 14 mm. Additionally, the axes of the head 8 and the handle 10 may be on the same or a different plane. A brush such as shown in FIG. 1 may also be adapted to electrically mechanized operation.

Figure 4:
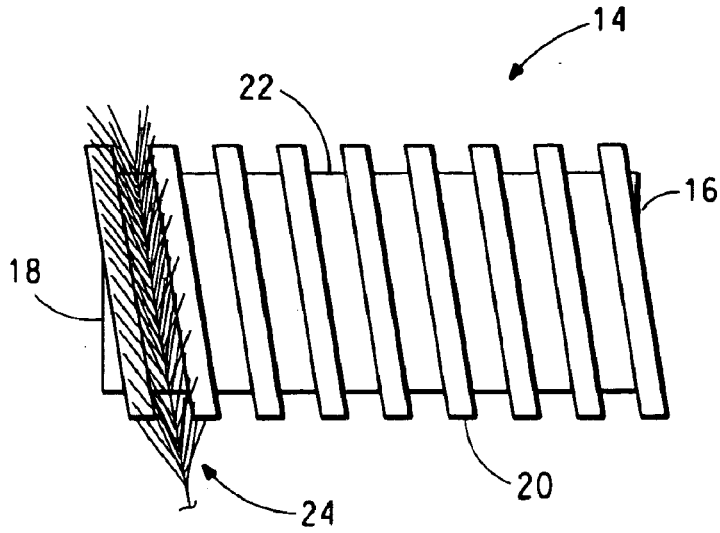
FIG. 4 shows a side elevation of a toothbrush.
Figure 5:
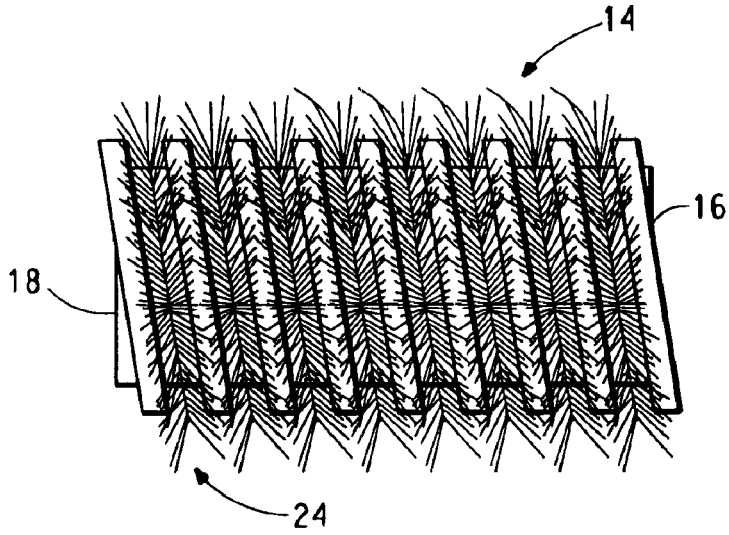
FIG. 5 shows a side elevation of a toothbrush.

Alternatively, a toothbrush of this invention may have a rounded or cylindrical shape in which bristles extend radially out from a central axis in multiple directions toward a circumferential perimeter about the central axis. For example, as shown in FIGS. 4 and 5, a cylindrical brush body 14 has first and second opposite axial ends 16 and 18 and a generally cylindrical sidewall 20. A spiral groove 22 is formed in the cylindrical sidewall 20 and extends from end 16 to end 18. Bristles 24 are secured within the spiral groove and extend from the cylindrical sidewall. Multiple spiral grooves, which may optionally be truncated, could also be used for this purpose. Although not shown, a variation on this embodiment would be to cut longitudinal grooves in the cylindrical sidewall, parallel to the central axis, and secure bristles in each of those longitudinal grooves. The grooves as described above may be machined into a solid, cylindrically-shaped brush body, or, if the brush body is hollow, bristles as seated in the grooves may be secured from the inside of the brush body.

Figure 6:
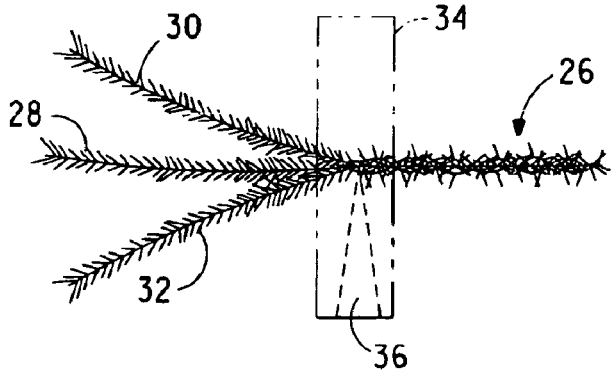
FIG. 6 shows a twisted bristle toothbrush.

Alternatively, in a toothbrush of this invention having a rounded or cylindrical shape, securing means other than a brush body may be used to secure bristles that extend radially out from a central axis in multiple directions toward a circumferential perimeter about the central axis. For example, as shown in FIG. 6, a cylindrical brush 26 may be formed by twisting, plying or wrapping together two or more bristle sub-assemblies, such as bristle sub-assemblies 28, 30 and 32. A twisting machine 34 of any appropriate design can be used to twist together the bristle sub-assemblies. Twisted bristle sub-assemblies may be bonded together by a fast setting adhesive or solvent applied by device 36 at the junction of the converging bristle sub-assemblies. Other fastening techniques may be employed, such as extrusion of a polymeric material, heat fusion and frictional interlocking.

FIG. 7 shows a variation of the embodiment of FIG. 6, in which a brush 38 is made by spiral wrapping two strands of securing material 40 and 42 with bristles 44. A twisting device 46 takes the three separate feeds, creates a retaining device from the securing material, for example wire, clasps the bristles with the retaining device, and produces the spiral-wrapped brush 38. An end view of the brush 38 is shown in FIG. 8. An end view of the brush 26 would have a similar appearance. This type of toothbrush is sometimes referred to as an inter-dental or inter-proximal brush.

In a toothbrush of this invention that has a rounded or cylindrical shape in which bristles extend radially out from a central axis in multiple directions toward a circumferential perimeter about the central axis, the portion of the bristles protruding from the central axis may have a length of about 0.5 to about 6, and preferably about 1 to about 4, mm. The term toothbrush is not limited herein to any of the particular embodiments illustrated or discussed above, and may for example be made from a bristle subassembly, as described in U.S. Ser. No. 09/092,094, which is incorporated and made a part hereof as fully as if set forth herein.

The advantageous effects of this invention are demonstrated by a series of examples, as described below. The embodiments of the invention on which the examples are based are illustrative only, and do not limit the scope of the invention. The significance of the examples is better understood by comparing these embodiments of the invention with certain controlled formulations, which do not possess the distinguishing features of this invention.

The compositions tested in the examples were prepared by blending nylon 6,12 with a masterbatch in which nylon 6,12 had been modified by the addition of a slip agent such as poly(tetrafluoroethylene) ("PTFE"). The PTFE used was Teflon® MP1400 or MP1600 Micropowder from DuPont, and was used at a content level of 30 weight percent of the masterbatch. Teflon® MP1400 Micropowder has an average particle size in the range of 7 to 12 microns, and Teflon® MP1600 Micropowder has an average particle size in the range of 4 to 12 microns. The controls involved testing of nylon 6,12 to which there was no addition of a slip agent.

In the case of both the examples and the controls, the blended composition, or the nylon itself, was melted and mixed in an extruder, and was then metered by a melt pump and forced through a spin pack and spinneret plate to form round strands. The strands were quenched in water, then heated above the glass transition point of the nylon and stretched between 3 to 5 times the initial length to give an oriented filament. The filament was then heat set in air at between 150 and 180° C. in order to impart the type of bend recovery required for a toothbrush filament. The filament was subsequently coated with a surface lubricant and then packaged.

Filaments made in the manner described above were tested to determine coefficient of friction by the boundary friction test described below, and were also used as the bristles from which a toothbrush was made. Each toothbrush was a 44 tuft, flat trim toothbrush made by the staple set process, and was similar to that shown in FIG. 1.

The filament size and content of the compositions tested in the examples are shown in Table 1, in which the amount of Teflon® MP1400 or MP1600 Micropowder in the final composition is shown, the remainder of each composition being nylon 6,12. As Controls A and B were each made from with nylon without the addition of any slip agent, they are shown in Table 1 as containing no Teflon® Micropowder.

TABLE 1

Amount of Teflon ® Micropowder and filament size in Examples 1–7 and Control A and B

| | Type of micropowder | Weight Percent of micropowder | Filament size |
|---|---|---|---|
| Example 1 | MP1400 | 2% | 8 mil |
| Example 2 | MP1400 | 4% | 8 mil |
| Example 3 | MP1600 | 2% | 8 mil |
| Example 4 | MP1600 | 4% | 8 mil |
| Control A | None | None | 8 mil |
| Example 5 | MP1600 | 1% | 7 mil |
| Example 6 | MP1600 | 2% | 7 mil |
| Example 7 | MP1600 | 4% | 7 mil |
| Control B | None | None | 7 mil |

The filaments in Examples 1–7 and Controls A and B were tested to determine coefficient of friction by the boundary friction test. Friction is the resistance to relative motion of two bodies in contact caused by inequalities in the surfaces of the respective materials from which the bodies are made. The ratio of (i) the force required to maintain a uniform velocity of one body with reference to the other to (ii) the perpendicular pressure between the surfaces is the coefficient of friction, which is a unitless value. Coefficient of friction by the boundary friction test is determined by use of a boundary frictometer.

A boundary frictometer is shown in FIG. 9. It measures the coefficient of friction when material (in this case filament) is in contact with material, and when material (filament) is in contact with a polished chrome surface. When a filament/filament measurement is made, a sample of the filament is wound onto a paper core or tube 48 that is mounted on a rotating mandrel 50. A loose filament 52 made from the same material is draped over the filament-covered core 48. One end of the draped filament 52 is attached to a strain gauge 54, such as a Statham transducer, and the other end is attached to a weight 56. The weight may be any amount that is effective to hold the draped filament in tight contact with the core 48, but that does not distort the performance of the draped filament or overload the strain gauge. Thirty grams is a typical amount of such weight. The filament-covered core 48 rotates at speeds of 0.0016 cm/s to 32 cm/s. The tension generated by the movement of the filament-covered core 48 across the draped filament 52 is measured by the strain gauge, and the value of the coefficient of friction is calculated from the tension data. When a filament/metal measurement is made, the same procedure as described above is followed except that the loose filament 52 is draped over a polished chrome surface on the mandrel instead of over the filament-covered core 48.

The results of the filament/filament boundary friction test for Examples 1~4 and Control A are shown below in Table 2. In Table 2, the speeds shown are the different speeds of the mandrel in centimeters/sec (cm/s) at which the measurement was performed. These results show that at each speed at which the measurement was made, the filaments used in Examples 1~4, containing a slip agent, experienced a lower coefficient of friction than the filament used in Control A, which did not contain a slip agent. The lower coefficient of friction indicates that, because of the presence of the slip agent in the filaments used in Examples 1~4, there was less friction between the draped filament and the filament-covered core than there was in the case of Control A, in which a filament was used that contained no slip agent.

TABLE 2

| | Results of Filament/Filament Boundary Friction Test | | | | | |
|---|---|---|---|---|---|---|
| | 0.0016 cm/s | 0.0032 cm/s | 0.0320 cm/s | 0.3200 cm/s | 3.200 cm/s | 32.0000 cm/s |
| Example 1 | 0.25 | 0.25 | 0.24 | 0.24 | 0.23 | 0.26 |
| Example 2 | 0.23 | 0.22 | 0.22 | 0.22 | 0.22 | 0.24 |
| Example 3 | 0.24 | 0.24 | 0.23 | 0.22 | 0.22 | 0.24 |
| Example 4 | 0.21 | 0.20 | 0.20 | 0.20 | 0.20 | 0.22 |
| Control A | 0.38 | 0.40 | 0.56 | 0.50 | 0.36 | 0.40 |

The results of the filament/metal boundary friction test for Examples 1~4 and Control A are shown below in Table 3. In Table 3, the speeds shown are the different speeds of the mandrel in centimeters/sec (cm/s) at which the measurement was performed. These results show that at each speed at which the measurement was made, the filaments used in Examples 1~4, containing a slip agent, experienced a lower coefficient of friction than the filament used in Control A, which did not contain a slip agent. The lower coefficient of friction indicates that, because of the presence of the slip agent in the filaments used in Examples 1~4, there was less friction between the draped filament and the metal surface than there was in the case of Control A, in which a filament was used that contained no slip agent.

TABLE 3

| | Results of Filament/Metal Boundary Friction Test | | | | | |
|---|---|---|---|---|---|---|
| | 0.0016 cm/s | 0.0032 cm/s | 0.0320 cm/s | 0.3200 cm/s | 3.200 cm/s | 32.0000 cm/s |
| Example 1 | 0.22 | 0.21 | 0.22 | 0.23 | 0.26 | 0.34 |
| Example 2 | 0.21 | 0.22 | 0.22 | 0.22 | 0.23 | 0.31 |
| Example 3 | 0.21 | 0.21 | 0.21 | 0.23 | 0.24 | 0.32 |
| Example 4 | 0.20 | 0.20 | 0.21 | 0.23 | 0.24 | 0.32 |
| Control A | 0.32 | 0.31 | 0.33 | 0.37 | 0.47 | 0.69 |

The results of the filament/metal boundary friction test for Examples 5~7 and Control B are shown below in Table 4. In Table 4, the speeds shown are the different speeds of the mandrel in centimeters/sec (cm/s) at which the measurement was performed. These results show that at each speed at which the measurement was made, the filaments used in Examples 5~7, containing a slip agent, experienced a lower coefficient of friction than the filament used in Control B, which did not contain a slip agent. The lower coefficient of friction indicates that, because of the presence of the slip agent in the filaments used in Examples 5~7, there was less friction between the draped filament and the metal surface than there was in the case of Control B, in which a filament was used that contained no slip agent.

TABLE 4

| | Results of Filament/Metal Boundary Friction Test | | | | | |
|---|---|---|---|---|---|---|
| | 0.0016 cm/s | 0.0032 cm/s | 0.0320 cm/s | 0.3200 cm/s | 3.200 cm/s | 32.0000 cm/s |
| Example 5 | 0.12 | 0.11 | 0.11 | 0.13 | 0.16 | 0.34 |
| Example 6 | 0.12 | 0.11 | 0.12 | 0.12 | 0.14 | 0.33 |
| Example 7 | 0.11 | 0.10 | 0.10 | 0.10 | 0.11 | 0.23 |
| Control B | 0.14 | 0.13 | 0.14 | 0.16 | 0.24 | 0.44 |

A toothbrush was made, using the filaments of Examples 5~7 and Controls A and B, respectively, as the bristles of the brush. Each brush was tested to determine the interproximal access efficacy ("IAE") of the brush stroke. The testing equipment was fabricated according to the design of Nygaard-Ostby, Edvardsen and Spydevold as described in Access to Interproximal Tooth Surfaces by Different Bristle Designs and Stiffnesses of Toothbrushes, Scand. J. Dent. Res. 1979: 87: 424–430. The testing technique to evaluate brushing efficacy involved independent evaluations of each toothbrush in both a vertical and horizontal brushing motion, on tooth shapes simulating anterior and posterior teeth, and at a brushing weight of 250 grams. All brushes were stored at a temperature of 67–70° F. for a minimum of 48 hours before testing. Brushing was conducted with the bristles placed at a 90 angle to the tooth surface. The brushing apparatus was set to brush 15 seconds at two strokes per second with a 50 mm stroke. The maximum width or IAE of the brushing stroke was recorded on pressure-sensitive paper placed around the simulated anterior or posterior teeth. The various tests on each brush were repeated four times.

The results of the test to determine IAE are shown below in Table 5. In Table 5, the four types of tests are labeled AV, PV, AH and PH. AV is anterior vertical (i.e. a vertical stroke on an anterior tooth surface), PV is posterior vertical, AH is anterior horizontal, and PH is posterior horizontal. For each example or control, the mean and standard deviation ("S.D.") of the four repetitions of each type of test are reported, as are an overall score that is calculated by taking the mean and standard deviation of all sixteen tests performed on a particular brush. The reported results are measured in mm, and are in each case the width of the area cleaned by the particular brush stroke.

TABLE 5

IAE Test Results

| | AV | | PV | | AH | | PH | | Overall | |
|---|---|---|---|---|---|---|---|---|---|---|
| | Mean | S.D. | Mean | S.D. | Mean | S.D. | Mean | S.D. | Mean | S.D. |
| Example 5 | 0.83 | .05 | 1.11 | .03 | 0.67 | .05 | 0.51 | .03 | 0.78 | .23 |
| Example 6 | 0.87 | .05 | 1.11 | .02 | 0.68 | .04 | 0.61 | .05 | 0.82 | .20 |
| Example 7 | 0.85 | .06 | 1.13 | .03 | 0.70 | .04 | 0.78 | .12 | 0.86 | .17 |
| Control A | 0.75 | .04 | 1.09 | .03 | 0.68 | .04 | 0.56 | .08 | 0.77 | .21 |
| Control B | 0.82 | .06 | 1.10 | .02 | 0.69 | .05 | 0.56 | .05 | 0.79 | .21 |

The results in Table 5 show that, with very few exceptions, the brushes containing bristles made from the composition of nylon and a slip agent (Examples 5~7) cleaned a wider area than the brushes in which the bristles contained no slip agent (Controls A and B). The brushes of Examples 5~7 were able, in a stroke of the same size, to clean a wider area than the brushes of Controls A and B because the slip agent present in the bristles of the brushes of Examples 5~7 reduced the friction experienced by those bristles in contact with the tooth, enabling the bristles to move further in each stroke. The greater width of cleaned area attained by the brushes of Examples 5~7 also results in their attainment of a higher IAE score, indicating that they would have greater cleaning efficiency, particularly interproximal efficiency, than the brushes with bristles that contain no slip agent.

What is claimed is:

1. A method of cleaning teeth comprising (a) providing a brush that comprises bristles that are prepared from a composition comprising a thermoplastic polymeric resin in admixture with a slip agent to improve cleaning efficacy of the bristles of the brush contacting said teeth, wherein the slip agent is one or more members of the group consisting of a fluorinated olefin polymer, hexagonal boron nitride, molybdenum disulfide, and fullerene; and (b) applying the brush to the surface of one or more teeth to clean the teeth.

2. A method according to claim 1 wherein step (a) comprises a step of selecting as the thermoplastic polymeric resin one or more members of the group consisting of polyamide, polyester, polyolefin, fluoropolymers, polyurethane, polyvinylchloride, polyvinylidene chloride, and styrenic polymers and copolymers.

3. A method according to claim 1 wherein step (a) comprises a step of selecting as the thermoplastic polymeric resin a polyamide.

4. A method according to claim 3 wherein the polyamide is nylon 6,12.

5. A method according to claim 1 wherein step (a) comprises a step of selecting as the slip agent polytetrafluorethylene.

6. A method according to claim 1 wherein step (a) comprises a step of preparing a composition that comprises the slip agent in an amount of about 0.5 or more, and yet about 10 or less, weight percent based on the total weight of the composition of polymer plus slip agent.

7. A method according to claim 1 wherein step (a) comprises a step of providing a brush on which the bristles extend out from a planar surface.

8. A method according to claim 1 wherein step (a) comprises a step of providing a brush on which the bristles extend radially out from a central axis in multiple directions toward a circumferential perimeter about the central axis.

9. A method according to claim 8 wherein the bristles are clasped by a twisted wire.

* * * * *